United States Patent [19]

Timmons

[11] 4,269,005

[45] May 26, 1981

[54] PANEL JOINING SYSTEM

[75] Inventor: Jay Timmons, Palos Verdes Estates, Calif.

[73] Assignee: Hiebert, Inc., Torrance, Calif.

[21] Appl. No.: 47,027

[22] Filed: Jun. 11, 1979

[51] Int. Cl.[3] ..... E04B 2/78

[52] U.S. Cl. ..... 52/36; 52/239; 52/241; 52/586

[58] Field of Search ..... 52/36, 239, 241, 242, 52/238, 278, 281, 586; 248/243

[56] References Cited

U.S. PATENT DOCUMENTS

| | | | |
|---|---|---|---|
| 3,713,257 | 1/1973 | Beavers | 52/36 |
| 3,866,370 | 2/1975 | Guarino et al. | 52/241 |
| 4,035,972 | 7/1977 | Timmons | 52/241 |
| 4,120,124 | 10/1978 | Temple et al. | 52/36 X |

FOREIGN PATENT DOCUMENTS

| | | | |
|---|---|---|---|
| 2718468 | 3/1979 | Fed. Rep. of Germany | 52/36 |
| 2849882 | 6/1979 | Fed. Rep. of Germany | 52/36 |
| 2303131 | 10/1976 | France | 52/241 |

*Primary Examiner*—J. Karl Bell

*Attorney, Agent, or Firm*—Fraser and Bogucki

[57] ABSTRACT

Relatively flat, generally planar panels having a pair of generally parallel, spaced-apart slots extending along the lengths of the upper, lower and opposite side edges thereof are joined together by a pair of thin, strip-like standards disposed within the slots at the facing side edges of an adjacent pair of panels and top and bottom connectors having an opposite pair of spaced-apart, generally parallel edges disposed within the slots at the top and bottom edges and fastened to the top and bottom edges by screws or similar fasteners. The top edge of each panel may be covered by a top cap generally coextensive with the top edge and having a plurality of brackets secured to the underside of the cap so that the opposite, downwardly extending edges of the brackets are resiliently secured within the pair of slots in the top edge of the panel. Selected side edges of the panel can be coupled to an end cap of configuration similar to to the top cap or to a corner post via a pair of the standards. The corner post has top and bottom connectors extending from a facing side edge thereof and a further pair of top and bottom connectors extending from an adjacent side edge thereof for coupling to a second panel disposed generally normal relative to a first panel coupled to the corner post. The standards are slotted along the lengths thereof to receive fingers extending through the small space between adjacent side edges of a pair of joined panels and into one of the slots from mounting brackets for mounting work tops, shelves and other members to the sides of the joined panels. The bottom edge of each panel is coupled to a plurality of support brackets adjustable in length along a central portion thereof to adjust the height of the panel and having spring-loaded plungers mounted at the opposite ends of transverse upper and lower arms for resiliently receiving a pair of opposite base plates.

17 Claims, 16 Drawing Figures

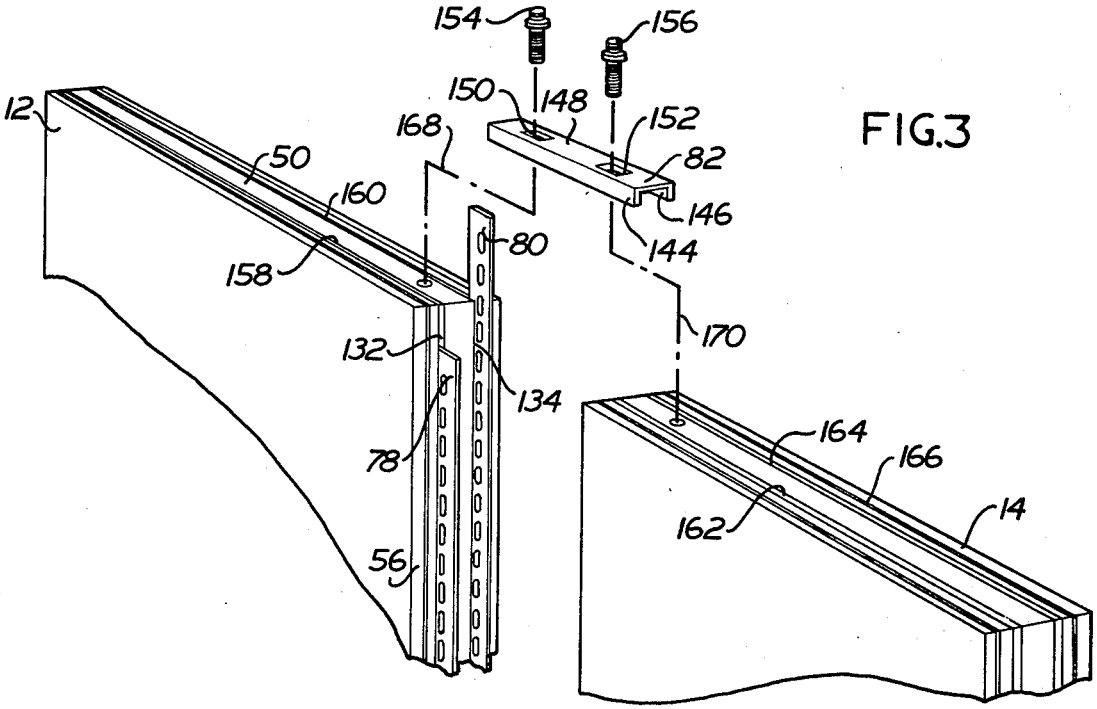
FIG.3
FIG.4
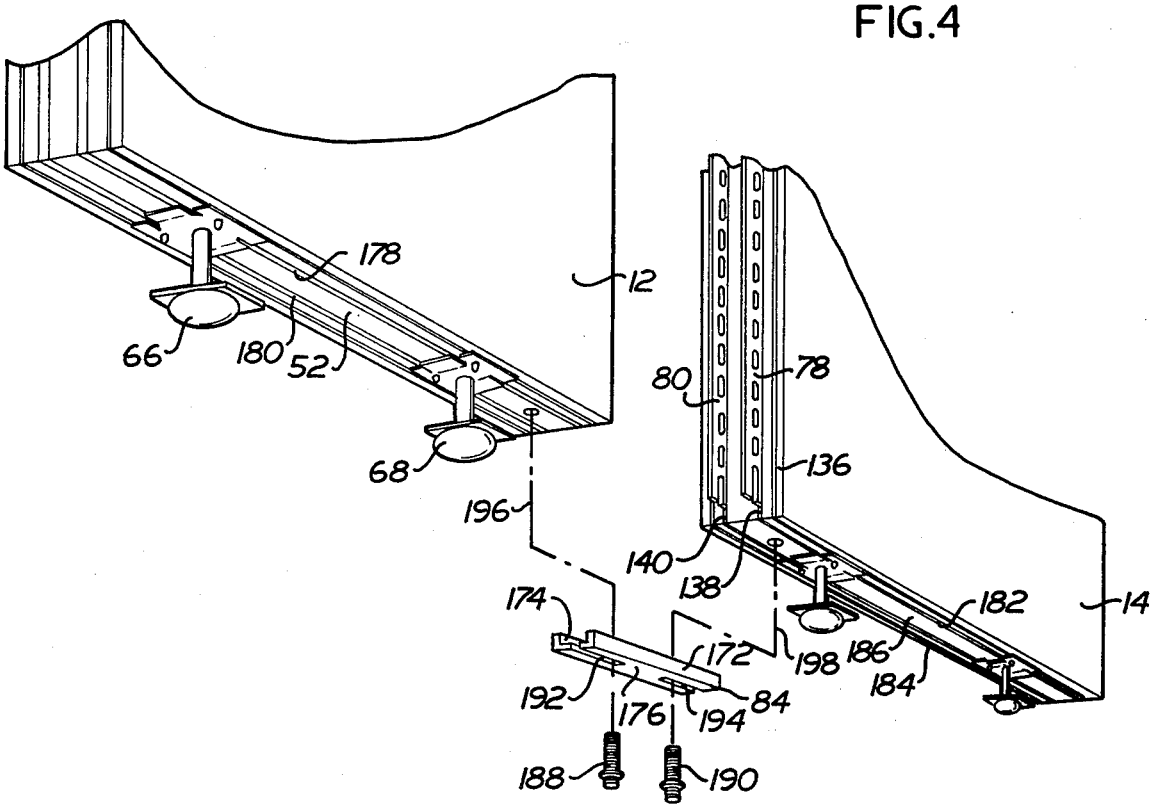

PANEL JOINING SYSTEM

BACKGROUND OF THE INVENTION

1. Field of the Invention

The present invention relates to arrangements for releaseably joining structural members together, and more particularly to arrangements for releaseably joining large panels of thin, planar configuration of the type used as office furnishings and the like.

2. History of the Prior Art

It is becoming increasingly popular to furnish offices and other rooms or spaces using a panel system in which a plurality of large panels of thin, planar configuration and of like or different size are joined together. The joined panels form wall units which can act as partitions and which are used to support such objects as shelves and desk tops, resulting in work areas of desired configuration.

Panel systems are most effective when the individual panels, corner posts and the like are easily assembled and disassembled. The nature of most offices using such systems requires that the individual panels and other components be easily disassembled from an existing arrangement for assembly into a different arrangement in the same or a different location. At the same time the individual panels and other members of the system must be relatively firm and rigid when assembled so as to act much in the same manner as building walls and permanent pieces of furniture when assembled and put to use.

Examples of panel systems which have been successfully used in various office and other environments include U.S. Pat. No. 4,067,165, PANEL SYSTEM, Timmons, and U.S. Pat. No. 4,035,972, PANEL JOINING ARRANGEMENTS, Timmons, both of which are commonly assigned with the present application. Other examples of panel systems are provided by U.S. Pat. Nos. 3,806,102 of Albinson et al, 3,713,257 of-Beavres, 3,694,975 of Pollock, 1,208,568 of Kane, 3,492,766 of Andrew, 3,471,978 of Fenwick, 3,648,419 of Marks, 2,796,158 of Miles et al, 3,174,592 of Berman et al and U.S. Pat. No. Re. 27,215 of Propst et al.

The panel arrangements described in the two above indentifiedTimmons patents work very well for a great variety of different environments and applicatons for such systems. However, there occasionally arises the need for features not present in such arrangements as well as a desire to provide alternative panel joining arrangements for various reasons. For example, it may become desirable or necessary to replace one or more panels in an existing panel arrangment in the face of limited clearance above the panels and without the need to move or remove various portions of the existing panel arrangement. In the arrangement shown in the U.S. Pat. No. 4,135,972 of Timmons, an elongated spacing member disposed within large slots at the facing edges of an adjacent pair of panels must be removed before one of the panels can be moved laterally relative to the other. The spacing member must be lifted vertically so as to completely clear both panels before one of the panels can be moved laterally relative to the other. However, where space above the joined panels is limited such as by a low ceiling, the rigid spacing member cannot be raised high enough to clear the panels. In such situations relative lateral movement of the joined panels cannot be accomplished without first pulling the joined panels away from each other. Such action may require movement or disassembly of large or cumbersome arrangements of the assembled panels, all to accomplish the simple act of replacing a single panel within the assembly of panels. Similar comments apply to U.S. Pat. No. 4,067,165 of Timmons where the facing edges of joined panels must be pulled away from one another far enough to remove a plurality of dowels from one or both of the facing edges.

Other desirable features in a panel system include panels which are of relatively simple configuration and therefore easy to construct and a system for joining or disassembly of the panels which is relatively easy to carry out and which does not require pounding or forcing of the panels together. Work tops, shelves and other components are desirably mounted on the panels using an arrangement which permits relatively easy disassembly or removal of such items while at the same time avoiding the necessity for holes or other obliteration of the side surfaces of the panels.

Accordingly, it is an object of the invention to provide an improved panel system.

It is a further object of the invention to provide a panel system in which the individual panels are of relatively simple construction and are relatively easily assembled and disassembled.

It is a still further object of the invention to provide a panel system in which a single panel can be removed or replaced within an existing assembly of the panels in the face of limited overhead space and without the need to move or disassemble other portions of the assembly.

BRIEF DESCRIPTION OF THE INVENTION

Panel arrangements in accordance with the invention utilize panels of relatively flat, generally planar configuration having top, bottom and opposite side edges provided with a pair of generally parallel, spaced-apart slots extending along the lengths of the edges. The facing side edges of an adjacent pair of panels are joined by an arrangement which includes a pair of thin, elongated, striped-like standards extending between the facing side edges of the panels and extending into different ones of the two different slots in each panel edge. An elongated top connector extends between and is fastened to the top surfaces of the adjacent panels. The top connector includes a pair of generally parallel, spaced-apart edges extending downwardly therefrom and engaging the two different slots in the top edges of the panels to provide lateral rigidity. A bottom connector having a configuration similar to that of the top connector except inverted, extends between and is fastened to the bottom edges of the adjacent panels with a pair of generally parallel, spaced-apart upwardly extending edges thereof residing within the slots in the bottom edges of the panels. The standards are slotted along the lengths thereof to receive fingers from one or more mounting brackets extending into the small space between the facing side edges of the adjacent panels and engaging the slots within the standards to mount the brackets and work tops, shelves or other member attached to the brackets.

Disassembly of a joined pair of panels is accomplished by first removing the screws or other connecting devices used to fasten the top and bottom connectors to the top and bottom edges respectively of the adjacent panels, following which the top and bottom connectors are themselves easily removed. If the panel arrangement is such that the adjacent panels cannot be pulled away from one another, the standards are pulled upwardly to remove them from the slots in the facing side edges of the panels. The standards are relatively thin and therefore highly flexible to facilitate removal and insertion thereof in the presence of limited clearance such as where the ceiling is relatively low. Once the standards are removed from the slots in the adjacent panels, one panel can be moved laterally relative to the other. Installation of a new panel in a space created by a previously removed panel is accomplished by positioning the new panel so that the opposite side edges thereof are disposed adjacent and slightly spaced apart from the side edges of other panels, cente posts and like members to which the new panel is to be joined. Precise positioning of the adjacent panels is accomplished when the bottom connector is installed in place using screws or other appropriate fasterners. The two standards are next inserted into the slots at the panel interface, with the flexible nature of the standards facilitating insertion thereof even in conditions of limited space. Installation of the top connector using screws or other connectors completes the joint.

A given side edge of a panel may be coupled to an adjacent panel or it may be coupled to an end post or a center post. The end post comprises an elongated, relatively thin member having a pair of generally parallel, spaced-apart slots along the length of a side edge thereof to receive the two different standards and having top and bottom connectors permanently affixed to the top and bottom ends thereof. The top and bottom connectors are fastened to the top and bottom edges respectively of the panel using screws or other fasteners. A center post has one side edge provided with a pair of slots and top and bottom connectors, and in addition has an adjacent side edge at right angles to the first side edge which is similarly equipped. The center post may be used to mount two panels at generally right angles to one another.

Each panel may be equipped with a top cap which is generally coextensive with the top edge thereof and which is held to the top of the panel by brackets fastened to the underside of the top cap. The brackets are generally U-shaped in cross-section so as to include a pair of generally parallel, spaced-apart edges extending downwardly from the underside of the top cap and resiliently engaging the opposite slots in the top edge of the panel to hold the top cap in place on top of the panel. An end cap of configuration similar to the top cap may be applied to one or both of the opposite side edges of a panel.

Each panel is preferably equipped with two or more support brackets mounted on the bottom edge thereof and having a central portion of adjustable length so as to vary the distance of a support foot at the opposite end of the central shaft portion from the bottom edge of the panel. A pair of arms mounted in spaced-apart relation along the length of the central shaft portion and extending transversely relative thereto terminate in resilient elements in the form of springloaded plungers for resiliently receiving the top and bottom edges of an opposite pair of base plates.

BRIEF DESCRIPTION OF THE DRAWINGS

The foregoing and other objects, features and advantages of the invention will be apparent from the following more particular description of a preferred embodiment of the invention, as illustrated in the accompanying drawings, in which:

FIG. 3 is a perspective, exploded view of two panels showing installation of a top connector and a pair of standards;

FIG. 4 is a perspective, exploded view of two panels showing installation of a bottom connector and a pair of standards;

DETAILED DESCRIPTION

Figure 1:
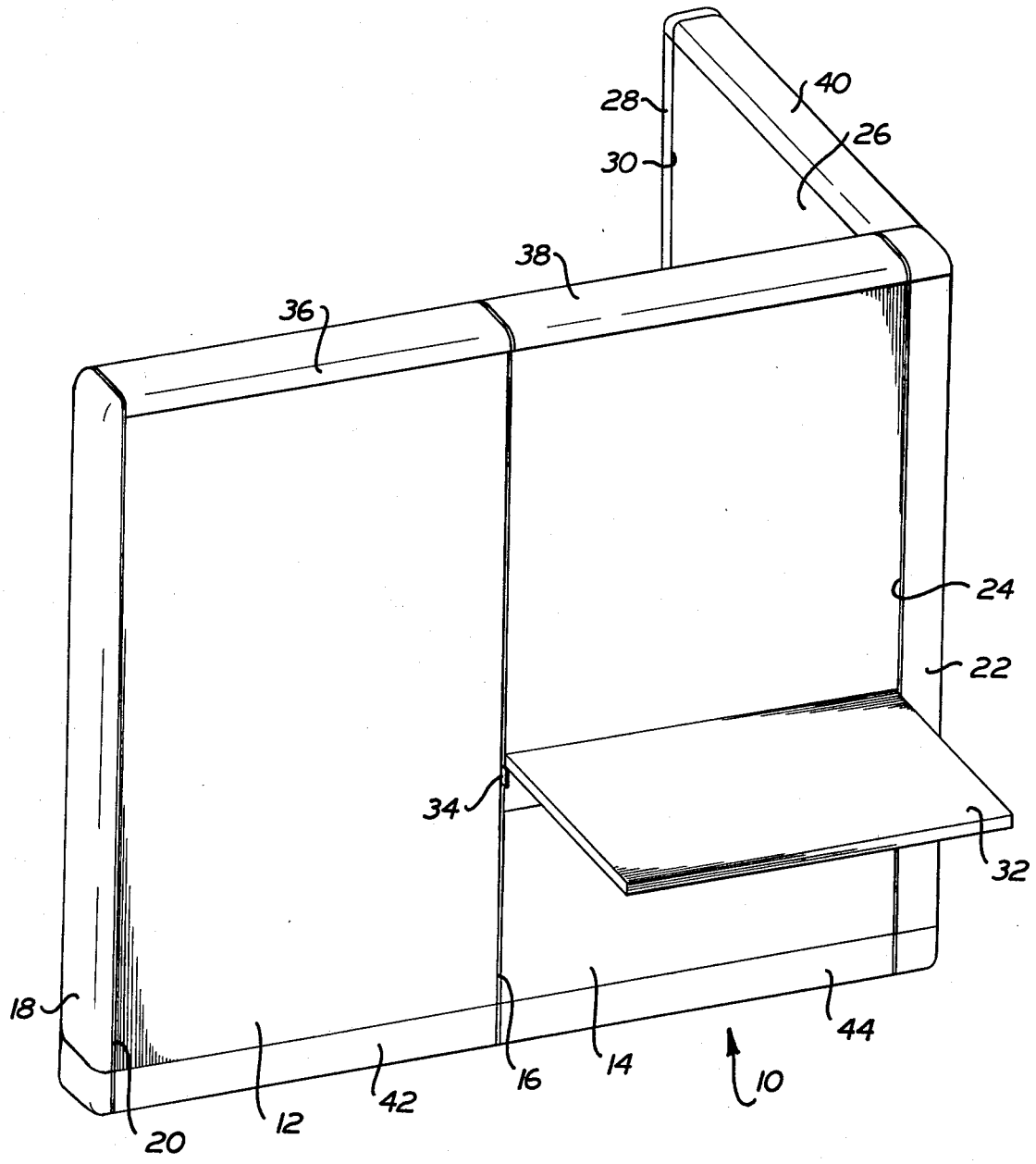
FIG. 1 is a perspective view of a panel system in accordance with the invention.

FIG. 1 depicts a panel system 10 in accordance with the invention. The panel system 10 includes a pair of panels 12 and 14 joined together to form a joint 16. The opposite end of the panel 12 has an end post 18 coupled thereto to form a joint 20. The end of the panel 14 opposite the panel 12 is coupled to a center post 22, forming a joint 24 therewith. An adjacent portion of the center post 22 is coupled to a third panel 26 so that the panel 26 forms generally right angles with the panel 14. The panel 26 terminates in an end cap 28 forming a joint 30 therewith.

In the particular arrangement of a panel system 10 shown in FIG. 1, a generally planar element 32 comprising a work top, a shelf or other fixture is coupled to the panel 14 by a plurality of mounting brackets with one such mounting bracket 34 being shown in FIG. 1. The mounting bracket 34 includes a finger which extends into the joint 16 and engages a slot within a slotted standard in the joint 16 as described hereafter. The opposite end of the planar element 32 is provided with a mounting bracket (not shown) which is mounted within the joint 24. The panel 12 has a top cap 36 mounted at the top thereof. Similarly, the panels 14 and 26 have top caps 38 and 40 respectively mounted on the tops thereof. A base plate 42 is mounted at the bottom of the panel 12. Likewise, a base plate 44 is mounted on the bottom of the panel 14.

The panel system 10 shown in FIG. 1 comprises one example of an arrangement in accordance with the invention. It will become apparent in connection with the following discussion that various other arrangements of the panels, end posts, center posts and end caps are possible in accordance with the invention.

Figure 2:
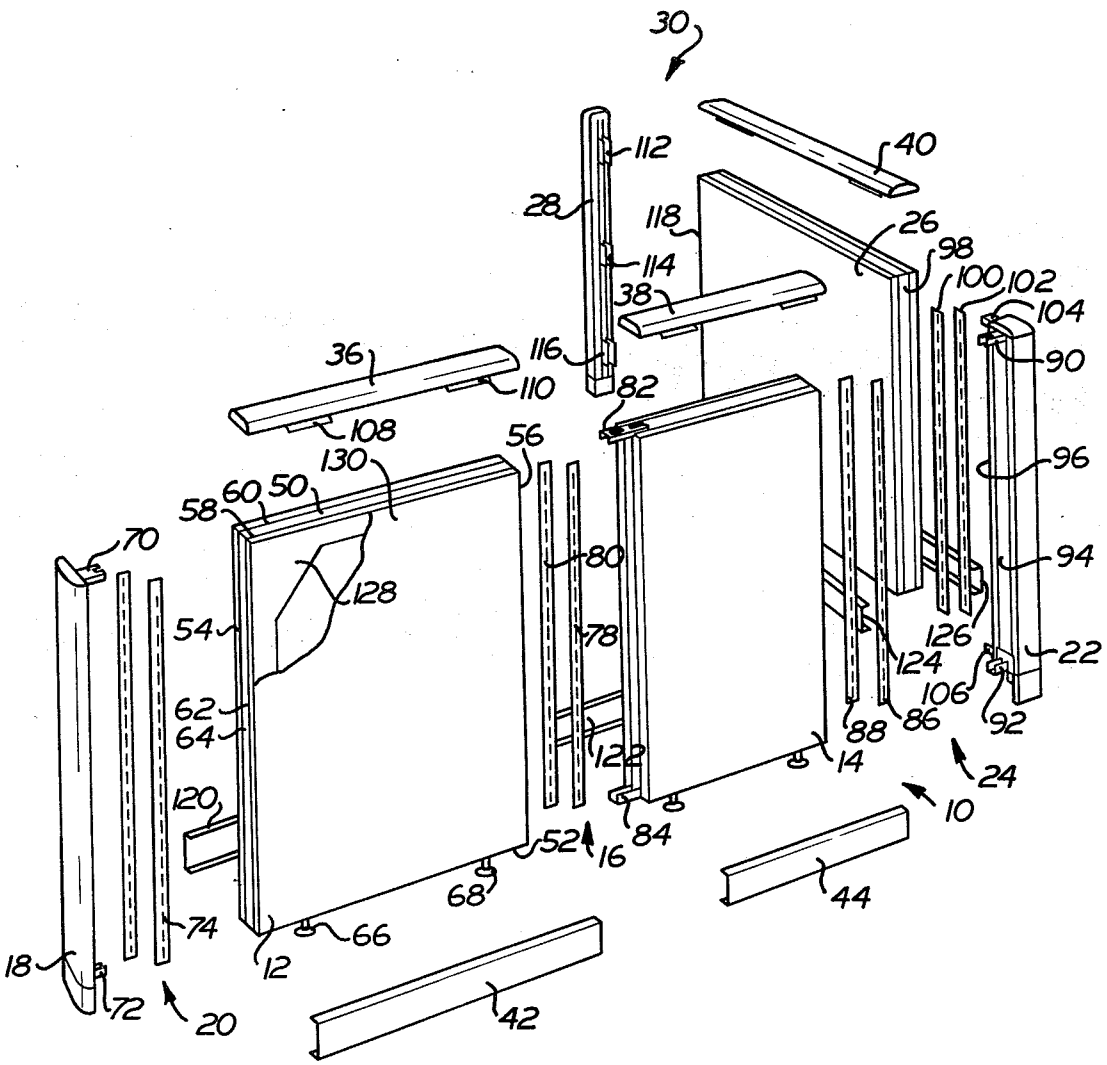
FIG. 2 is an exploded view of the panel system of FIG. 1.

FIG. 2 shows the panel system 10 of FIG. 1 exploded and with the planar element 32 and included mounting brackets omitted for clarity. The details of the mounting brackets and the manner in which they mount on the slotted standards are described hereafter in connection with FIGS. 6 and 7.

Referring to FIG. 2 the panel 12 which is of relatively thin, generally planar configuration includes a top edge 50, a bottom edge 52, a left side edge 54 and a right side edge 56. The top edge 50 is provided with a pair of generally parallel, spaced-apart slots 58 and 60 therein extending along the length thereof. The left side edge 54 is provided with a pair of generally parallel, spaced-apart slots 62 and 64 extending along the length thereof and joining with the slots 58 and 60 in the top edge 50. Although not shown in FIG. 2, the bottom edge 52 and the right side edge 56 are each similarly provided with a pair of slots. The slots in the left and right side edges 54 and 56 are used in joining the panel 12 to the end post 18 and the panel 14 respectively. The slots 58 and 60 in the top edge 50 are used to mount the top cap 36 on the panel 12 in addition to top connectors at the opposite ends thereof. The slots in the bottom edge 52 are used to mount bottom connectors at the opposite ends thereof in addition to a pair of support brackets 66 and 68.

The end post 18 is joined to the left side edge 54 of the panel 12 using a top connector 70 mounted on the top end of the end post 18, a bottom connector 72 mounted on the bottom end of the end post 18 and a pair of slotted standards 74 and 76. Each of the standards 74, 76 is of elongated, relatively thin, strip-like configuration. The standards 74 and 76 reside partly within the slots 62 and 64 in the left side edge 54 of the panel 12 and partly within a pair of slots formed on the inner surface of the end post 18 and not shown in FIG. 2. As described hereinafter, joints such as the joint 20 in the panel system 10 of FIG. 2 are formed using a pair of standards such as the standards 74 and 76 and top and bottom connectors such as the top connector 70 and the bottom connector 72. The top connector 70 is fastened to the top edge 50 of the panel 12. The bottom connector 72 is fastened to the bottom edge 52 of the panel 12.

The panel 12 is coupled to the panel 14 which is of like configuration using a pair of standards 78 and 80, a top connector 82 and a bottom connector 84. The opposite side edge of the panel 14 is coupled to the center post 22 using a pair of slotted standards 86 and 88, a top connector 90 mounted on the top end of the center post 22 and a bottom connector 92 mounted on the bottom end of the center post 22.

The center post 22 is coupled to the panel 14 at a side edge 94 of the center post 22. An adjacent side edge 96 forming right angles with the side edge 94 is mounted adjacent a side edge 98 of the panel 26 using a pair of standards 100 and 102, a top connector 104 mounted at the top end of the center post 22 and a bottom connector 106 mounted at the bottom end of the center post 22.

The top cap 36 has a pair of brackets 108 and 110 fastened to the underside thereof. As described in detail hereafter in connection with FIGS. 8–10, the brackets 108 and 110 resiliently engage within the slots 58 and 60 in the top edge 50 of the panel 12 to secure the top cap 36 in place on top of the panel 12. The top caps 38 and 40 are mounted on the tops of the panels 14 and 26 in like fashion. The end cap 38 is provided with three different brackets 112, 114 and 116 identical in construction to the brackets 108 and 110 on the underside of the top cap 36. The brackets 112, 114 and 116 resiliently engage within the pair of slots in a side edge 118 of the panel 26 to mount the end cap 28 on the end of the panel 26.

Figure 14:
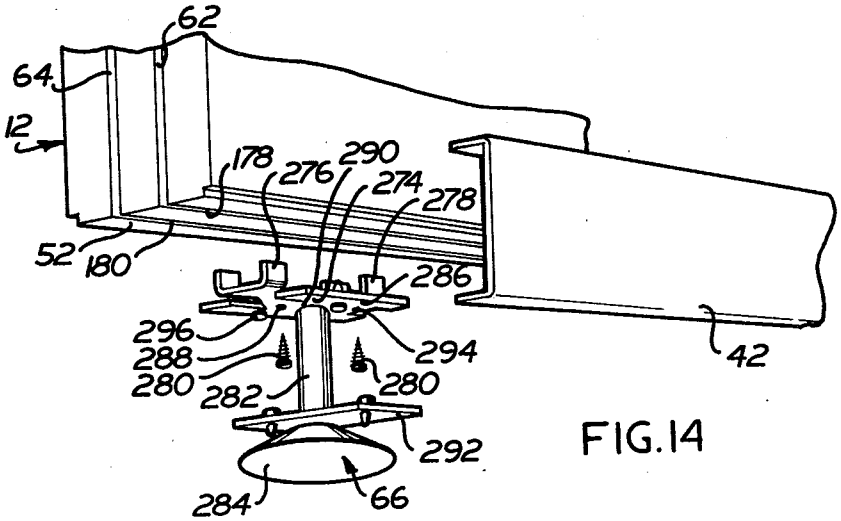
FIG. 14 is a perspective, exploded view of the bottom of a panel showing the details of the support brackets and a base plate.
Figure 16:
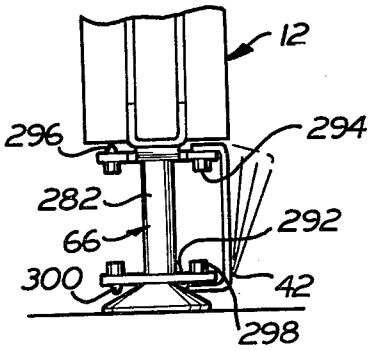
FIG. 16 is an end view of the arrangement of FIG. 14 showing the base plate installed.
Figure 15:
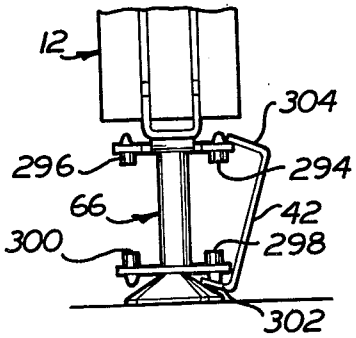
FIG. 15 is an end view of the arrangement of FIG. 14 showing how installation of the base plate is begun.

As described in detail hereafter in connection with FIGS. 14–16, the support brackets 66 and 68 at the bottom of the panel 12 rest on the floor or other support for the panel system 10. The base plate 42 and an opposite base plate 120 are resiliently mounted in place on the support brackets 66 and 68 to provide a finished appearance for the panel system 10 as well as to provide a raceway for electrical conduits and the like. In like fashion the base plate 44 and an opposite base plate 122 are mounted at the opposite sides of the bottom of the panel 14, and a pair of opposite base plates 124 and 126 is mounted at the opposte sides of the bottom of the panel 26.

As previously noted the panels 12, 14 and 26 are of relatively thin, generally planar configuration. The panels can be of any appropriate construction as determined by the application in which the panels are to be used. Typically, at least the outer periphery of a panel comprises a wood frane such as a frame 128 shown comprising a portion of the panel 12 in FIG. 2. The outer edges of the wooden frame 128 define the top and bottom edges 50 and 52 and the opposite side edges 54 and 56 in which the various pairs of slots are formed. In the case of the panel 12 the central portion of the panel defined by the space at the inside of the frame 128 is hollow and is covered by opposite sides such as a side 130 shown in FIG. 2. The side 130 can comprise a thin piece of wood veneer, a piece of fabric, or other appropriate finish material for the panel.

Figure 5:
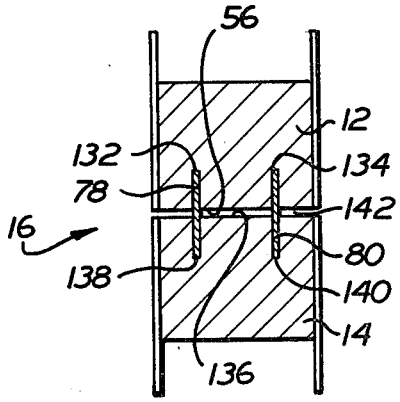
FIG. 5 is a sectional view of two joined panels.

FIGS. 3 and 4 depict the panels 12 and 14 together with the standards 78 and 80, the top connector 82 and the bottom connector 84. FIG. 5 is a cross-sectional view of the panels 12 and 14 upon being joined together. As shown in FIG. 3 the right side edge 56 of the panel 12 is provided with a pair of slots 132 and 134 for receiving the standards 78 and 80 respectively. As shown in FIG. 4 the panel 14 has a left side edge 136 provided with a pair of slots 138 and 144 receiving the standards 78 and 80 respectively.

When the standards 78 and 80 are disposed within the slots in the side edges 56 and 136 of the panels 12 and 14, a small space 142 remains between the side edges 56 and 136 as shown in FIG. 5. The space 142 is relatively small and yet is large enough to permit passage of portions of mounting brackets therethrough for engagement in the slots in the standards 78 and 80 as described hereafter in connection with FIGS. 6 and 7. The panels 12 and 14 and the standards 78 and 80 are secured in the position shown in FIG. 5 by the top connector 82 and the bottom connector 84.

As seen in FIG. 3 the top connector 82 is elongated in configuration and has a uniform, generally U-shaped cross-section defining an opposite pair of generally parallel, spaced-apart edges 144 and 146 extending downwardly from a central portion 148 of the top connector 82. The central portion 148 has a pair of apertures 150 and 152 adjacent the opposite ends thereof for receipt of screws 154 and 156 respectively. The edges 144 and 146 reside within slots 158 and 160 respectively disposed within the top edge 50 of the panel 12 and forming a continuation of the slots 132 and 134 in the right side edge 56 of the panel. The edges 144 and 146 at the opposite end of the top connector 82 are adapted to be received within slots 162 and 164 respectively formed in a top edge 166 of the panel 14. With the edges 144 and 146 of the top connector 82 disposed within the slots 158, 160, 162 and 164, the top connector 82 is joined to the opposite top edges 50 and 166 by the screws 154 and 156 respectively. The screw 154 extends through the aperture 150 and into the top edge 50 of the panel 12 as shown by the dashed line 168 in FIG. 3. Similarly, the screw 156 extends through the aperture 152 and into the top edge 166 of the panel 14 to secure the top connector 82 to the panel 14 as shown by the dashed line 170 in FIG. 3.

As shown in FIG. 4 the bottom connector 84 is of similar configuration to the top connector 82 except that it is inverted. Accordingly, an opposite pair of parallel, spaced-apart edges 172 and 174 extend upwardly from a central portion 176 of the bottom connector 84 to reside within slots 178 and 180 in the bottom edge 52 of the panel 12 and slots 182 and 184 in the bottom edge 186 of the panel 14. The bottom connector is secured to the bottom edges 52 and 186 by screws 188 and 190 which extend through aperatures 192 and 194 adjacent the opposite ends of the central portion 176 of the bottom connector 84 and into the bottom edges 52 and 186, as shown by dashed lines 196 and 198 respectively in FIG. 4.

It will be appreciated that with the top connector 82 and the bottom connector 84 installed, the facing side edges 56 and 136 of the panels are held in the adjacent, spaced-apart relation together with the standards 78 and 80 as seen in FIG. 5. The connectors 82 and 84 prevent either of the edges 56, 136 from being pulled away from the other edge. At the same time the pair of sides on the connectors 82 and 84 extending into mating slots in the adjacent edges of the panels prevent rotational or pivoting movement of either of the panels 12, 14 relative to to other. In short, the panels 12 and 14 are rigidly and securely fastened to one another. Yet uncoupling of the panels is a relatively simple procedure, even when only lateral movement of the panels is permitted. Thus, if a plurality of panels such as the panels 12 and 14 are joined together and it becomes necessary to replace one of the panels, the replacement is easily performed without movement of the other panels in the arrangement. Each of the opposite side edges of the panel to be replaced is uncoupled from the interfacing side edges of the adjacent panels by first removing the top connector at each joint. In the case of the panels 12 and 14, the top connector 82 is removed by loosening and then completely removing the screws 154 and 156. With the top connector 82 removed, the standards 78 and 80 can be removed by being pulled upwardly. Where overhead space above the panels 12 and 14 is limited, the thin, flexible nature of the standards 78 and 80 allows them to be bent outwardly as they are moved upwardly out of the slots. With the standards 78 and 80 removed, the screws 88 and 90 can be removed to permit removal of the bottom connector 84. With the top connector 82, the standards 78 and 80 and the bottom connector 84 removed, the panel 12 can be moved laterally relative to the panel 14 and vice versa. If panel 12 comprises the panel to be replaced in an existing arrangement of panels, then the opposite side edges thereof are freed from the interfacing sides edges of adjacent panels in the manner just described. The panel 12 may then be moved laterally outwardly and away from the adjoining panels.

The replacement panel is moved laterally into place relative to the adjacent panels, following which the bottom connectors are installed. In the case of the panels 12 and 14, the bottom connector 84 would be installed at the interface thereof using the screws 188 and 190. Thereafter, the pair of slotted standards is installed by sliding each standard down into the interfacing slots in the adjacent side edges of the panels. Again, where overhead space above the panels is limited, the thin, flexible nature of the standards enables them to be bent so as to be fit into the slots from an angle. When each pair of standards is so installed, a top connector is installed over the standards to complete the joint. In the case of the panels 12 and 14, the standards 78 and 80 are installed, following which the top connector 82 is installed in place using the screws 154 and 156.

Figure 6:
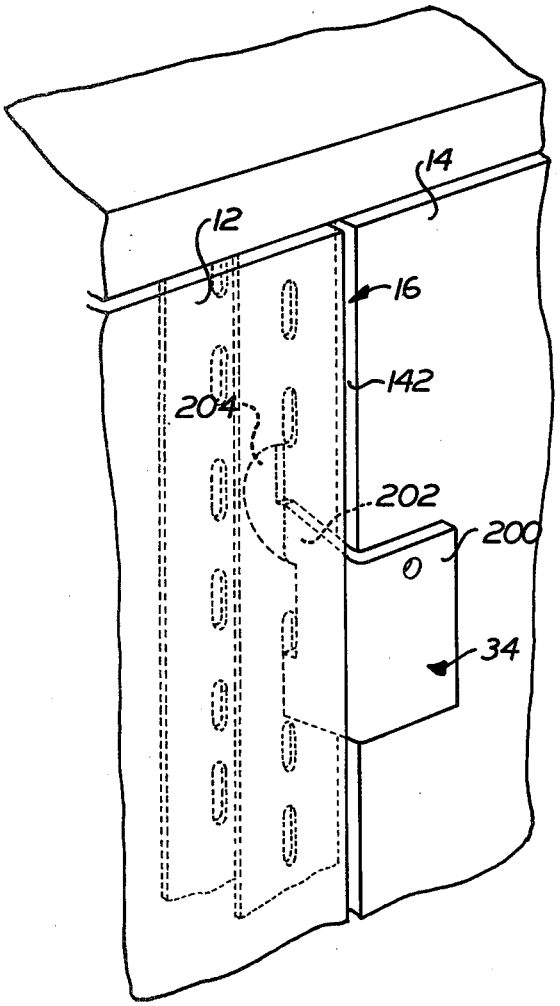
FIG. 6 is a perspective view of a panel joint showing the manner in which a mounting bracket is mounted on one of the slotted standards.
Figure 7:
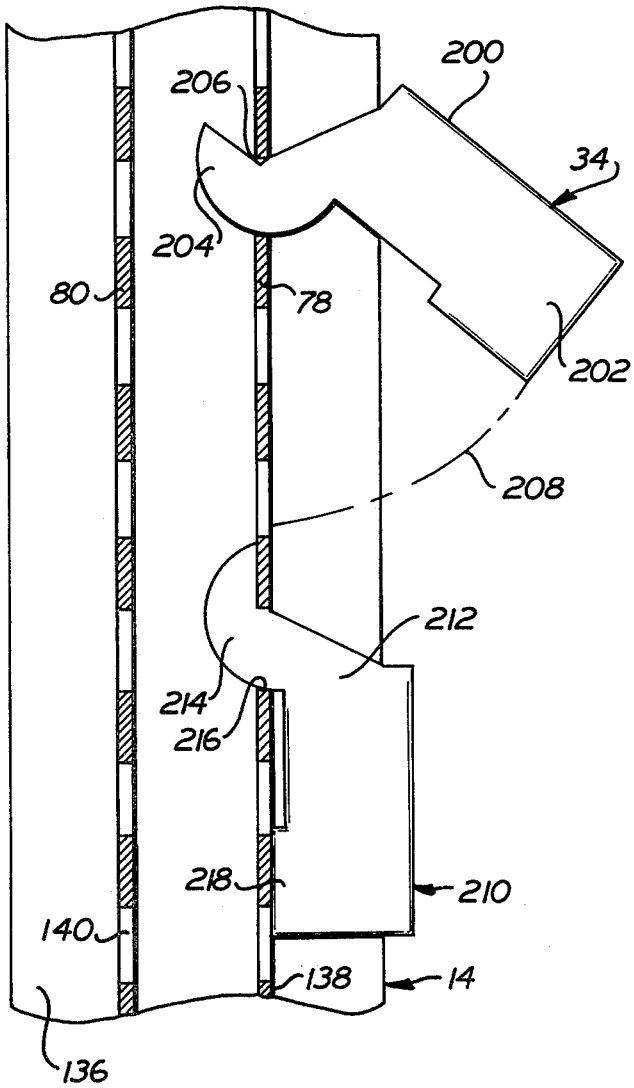
FIG. 7 is a sectional view of the joint of FIG. 6 showing the manner in which the fingers of the mounting brackets engage the slots in the standards.

FIGS. 6 and 7 depict in greater detail the manner in which mounting brackets such as the bracket 34 in FIG. 1 may be used to mount various objects on the panels such as the planar element 32 shown in FIG. 1. FIG. 6 depicts the joint 16 between the panels 12 and 14. As noted in connection with FIG. 5, a relatively smally space 142 is formed between the adjacent side adges 56 and 136 of the panels 12 and 14. The mounting bracket 34 shown in FIG. 6 has a main portion 200 thereof from which a finger-like portion 202 extends at generally right angles to the main portion 200. The finger-like portion 202 terminates in a finger 204. Installation and removal of the mounting bracket 34 are relatively simple procedures as shown in FIG. 7. In the case of FIG. 7 the mounting bracket 34 has the finger-like portion 202 thereof inserted into the space 142 from outside the panels 12 and 14 so that the finger 204 enters a slot 206 in the standard 78. The finger 204 is inserted in the slot 206 with the main portion 200 of the mounting bracket 34 held almost horizontally or at a relatively small angle relative to the horizontal. Upon insertion of the finger 204 into the slot 206, the mounting bracket 34 is rotated downwardly relative to the upper edge of the slot 206. The rotational movement of the bracket 34 is depicted by a dashed line 208 in FIG. 7.

A second mounting bracket 210 is shown in the installed position in the lower portion of FIG. 7. The mounting bracket 210 has a finger-like portion 212 which has been rotated downwardly so that a finger 214 extending therefrom which has been inserted in a slot 216 within the standard 78 fits tightly within the slot 216. This fit prevents downward or outward movement of the bracket 210 relative to the standard 78. The lower portion of the bracket 210 is supported by an edge 218 extending from the finger-like portion 212 and residing against the standard 78. The bracket 210 is dimensioned such that the edge 218 is positioned so as to principally reside against a portion of the standard 78 rather than the slots in the standard.

Removal of a mounting bracket such as the bracket 34 or 210 is a simple matter of rotating the bracket upwardly to permit the finger to rotate within and then completely withdraw from the engaging slot in the standard.

Figure 10:
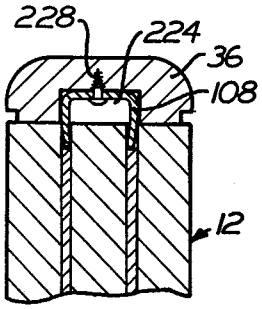
FIG. 10 is an end view of the arrangement of FIG. 8 showing the top cap installed on top of the panel.
Figure 9:
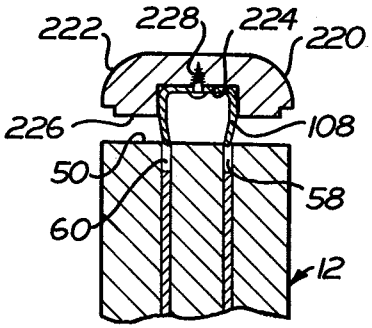
FIG. 9 is an end view of the arrangement of FIG. 8 showing the manner in which the top cap is initially positioned for installation on the panel.
Figure 8:
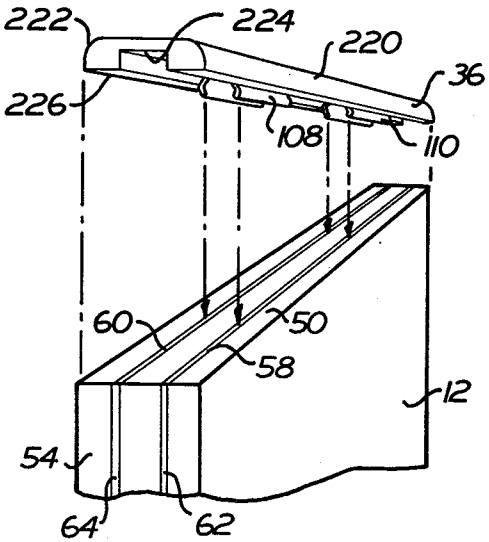
FIG. 8 is a perspective, exploded view of the top portion of a panel and an included top cap.

FIGS. 8–10 depict in detail the manner in which a top cap is mounted on a panel. FIGS. 8–10 depict the top cap 36 and the panel 12 of FIGS. 1 and 2. The top cap 34 has opposite rounded outer edges 220 and 222 and a longitudinal slot 224 formed in the underside 226 thereof. The brackets 108 and 110 which are generally U-shaped in cross-section are disposed within the slot 224 where they are secured using fasteners such as a screw 228. The opposite, downwardly extending legs of each bracket 108, 110 are curved slightly, and the brackets themselves are made of a resilient material such as spring steel. Consequently, with the opposite lets of the bracket 108 slightly disposed within the opposite slots 58 and 60 in the top edge 50 of the panel 12 as seen in FIG. 9, the curvature of the legs resists complete insertion thereof into the slots 58 and 60. However, with a small amount of downward pressure applied to the top cap 36, the opposite legs of the bracket 108 and the bracket 110 straighten under resistance to permit the legs to enter the slots 58 and 60 until the top cap 36 is seated on the top edge 50 of the panel 12 as shown in FIG. 10. In this position, the opposite legs of the brackets 108 and 110 bind within the slots 58 and 60 to hold the top cap 36 in place. However, the top cap 36 is easily removed by applying an upward force thereto relative to the panel 12. This may be accomplished by inserting an object such as a screwdriver into the space formed by the slot 224 with the top edge 50 and the prying upwardly on the top cap 36.

Figure 11:
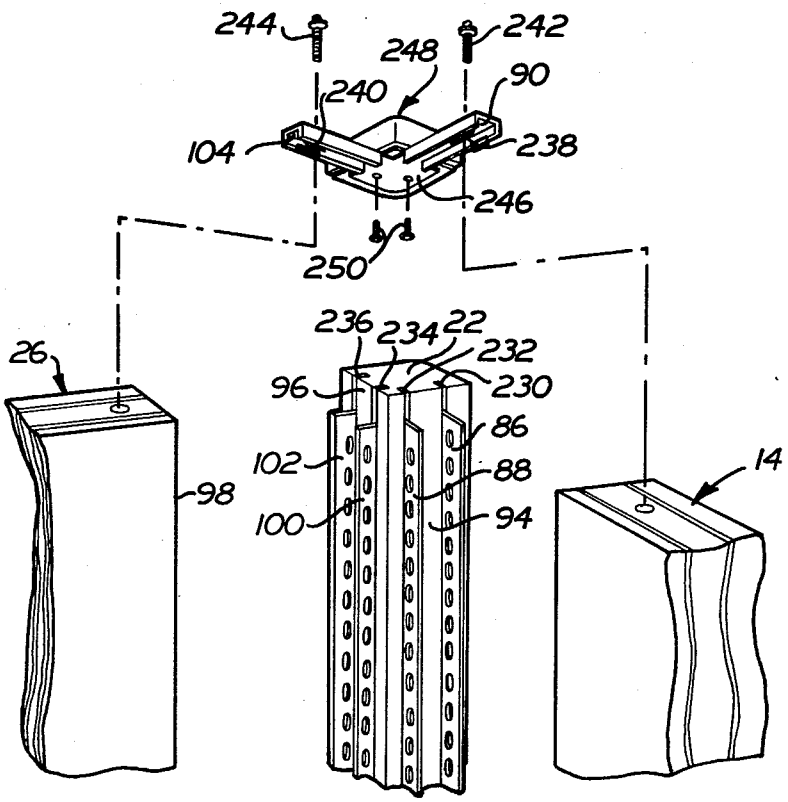
FIG. 11 is an exploded view of portions of two panels and a center post illustrating the manner in which they are joined together.

FIG. 11 depicts the panels 14 and 16 and 26 together with the center post 22 shown in FIGS. 1 and 2. As seen in FIG. 11 the side edge 94 of the center post 22 is provided with a pair of slots 230 and 232 for receiving the slotted standards 86 and 88 respectively. Similarly, the side edge 96 of the center post 22 is provided with slots 234 and 236 for receiving the slotted standards 100 and 102 respectively. With the standards 86 and 88 disposed within mating slots in the adjacent side edge of the panel 14, and with the standards 100 and 102 disposed within mating slots in the side edge 98 of the panel 26, the panels 14 and 26 are joined together with the center post 22 at the tops thereof by the top connectors 90 and 104. The top connectors 90 and 104 are of U-shaped cross-section along most of the length thereof and include apertures 238 and 240 respectively for receiving screws 242 and 244. The screw 242 passes through the aperture 238 and into the top edge of the panel 14. Likewise, the screw 244 passes through the aperture 240 and into top edge of the panel 26.

The portions of the top connectors 90 and 104 opposite the apertures 238 and 240 join to form an integral, common plate 246 which is secured to the bottom of a cap 248 such as by screws 250. The cap 248 in turn is secured to the top of the center post 222. This secures the top connectors 90 and 104 to the top end of the center post 22.

Figure 12:
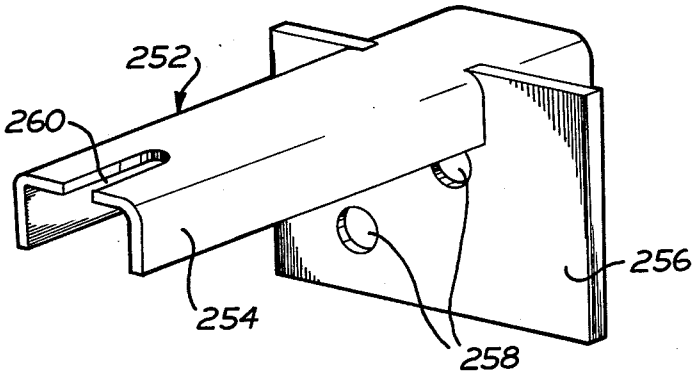
FIG. 12 is a perspective view of a device used as the top and bottom connectors of a center post or an end post.
Figure 13:
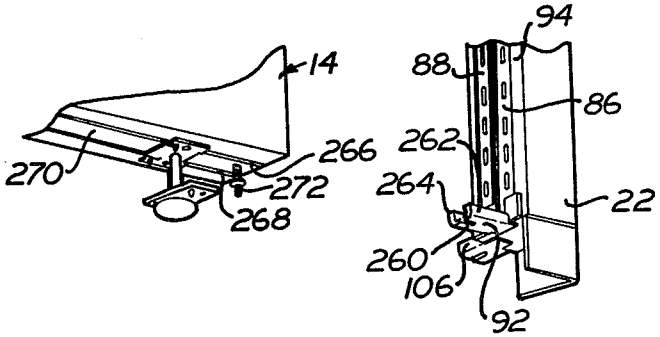
FIG. 13 is a perspective, exploded view of portions of a panel and center post showing the manner in which the bottom connector is used.

FIG. 12 depicts a connector 252 which may be secured to the top end of the center post 22 in place of the top connectors 90 and 104 shown in FIG. 11 and which in any event is used to form the bottom connectors 92 and 106 on the center post 22 as shown in FIG. 13. The connector 252 has a generally U-shaped portion 254 extending outwardly from a plate 256 having apertures 258 therein. The U-shaped portion 254 has a slot 260 formed in the outer end thereof. The plate 256 is used to mount the connector 252 such as to the center post 22. Where the connector 252 of FIG. 12 is used as the bottom connector 92 or 106, the connector 252 is inverted from the position shown in FIG. 12 and is secured to the lower end of the center post 22 by screws or other fasteners which extend through the apertures 258 in the plate 256. With the center post 22 disposed in the coupling position adjacent the panels, the slot 260 in the U-shaped portion 254 of the connector 252 receives a screw or other fastening device therein installed in the bottom edge of the adjacent panel. For example, as seen in FIG. 13, the bottom connector 92 may have the opposite, upwardly extending edges 262 and 264 thereof inserted in slots 266 and 268 respectively in the bottom edge 270 of the panel 14 so that a screw 272 in the bottom edge 270 extends into the slot 260 as the center post 22 is moved into position with the standards 86 and 88 against the panel 14. The screw 272 may then be tightened against the bottom connector 92 to secure the lower portion of the center post 22 in place against the panel 14.

The details of the support brackets such as the support brackets 66 and 68 shown in FIG. 2 and the manner in which they secure the base plates thereto are shown in FIGS. 14–16. FIGS. 14–16 depict a portion of the panel 12 together with the support bracket 66 and the base plate 42. The support bracket 66 includes a plate 274 at the upper end thereof. Opposite portions of the plate 274 are formed into a pair of upstanding tabs 276 and 278. The tabs 276 and 278 are received within the slots 178 and 180 respectively in the bottom edge 52 of the panel 12 when the plate 274 is mounted in place thereon. The tabs 276 and 278 serve both to properly locate the support bracket 66 relative to the bottom edge 52 and thereafter hold the plate 274 in position on the bottom edge 52 when secured thereto such as by screws 280.

The support bracket 66 further includes a central shaft 282 of cylindrical configuration extending downwardly from the plate 274 and terminating in a conical shaped foot 284. The bottom end of the shaft 282 includes a threaded bore for receiving a threaded shaft at the upper end of the foot 284. Consequently, rotation of the foot 284 relative to the shaft 282 displaces the foot 284 relative to the shaft 282 so as to adjust the height of the support bracket 66. Rotation of the foot 284 at the bottom of each support bracket thereby adjusts the height of each support bracket and thereby the height of the various panel portions supported by the support bracket.

The plate 274 has a pair of opposite portions 286 and 288 thereof forming an upper arm 290 which is transversely disposed relative to the shaft 282. A lower arm 292 mounted at the lower end of the shaft 282 is also transversely disposed relative to the shaft 282 and is generally parallel to the upper arm 290. The opposite ends of the upper arm 290 terminate in an opposite pair of resilient elements in the form of spring-loaded plungers 294 and 296. The opposite ends of the lower arm 292 terminate in resilient elements in the form of spring-loaded plungers 298 and 300. The spring-loaded plungers 294 and 298 serve to secure the upper and lower portions respectively of the base plate 42 to mount the base plate 42 at the bottom of the panel 12. The opposite base plate 120 shown in FIG. 2 but not shown in FIG. 14 is similarly mounted using the spring-loaded plungers 296 and 300 as the opposite side of the support bracket 66. The spring-loaded plungers 294, 296, 298 and 300 resiliently engage the opposite edges of the generally U-shaped base plates as shown in FIGS. 15 and 16. As shown in FIG. 15 the base plate 42 is installed by first seating a lower edge 302 thereof against the plunger 298 and then forcing an opposite upper edge 304 thereof over the plunger 294. The plungers 298 and 294 retract under spring tension as necessary to permit the base plate 42 to snap into place as shown in FIG. 16. To facilitate securing of the base plate 42 in place, the opposite edges 302 and 304 may be provided with detents or even slots to receive the plungers.

In addition to greatly improving the appearance of the bottom of a panel arrangement, the support brackets and engaging base plates also provide a convenient and suitable raceway for locating electrical conduiting and the like while providing convenient and easy access thereto.

While the invention has been particularly shown and described with reference to preferred embodiments thereof, it will be understood by those skilled in the art that the foregoing and other changes in form and details may be made therein without departing from the spirit and scope of the invention.

What is claimed is:

1. An arrangement for joining first and second panel members at facing portions thereof, the facing portions of each of the first and second panel members having a length extending between top and bottom portions of the panel, the arrangement comprising a first elongated member disposed between the facing portions of the first and second panel members, the first elongated member extending along at least a substantial portion of the length of each of the facing portions, a second elongated member disposed between the facing portions of the first and second panel members along a least a substantial portion of the length of each of the facing portions and generally parallel to and spaced-apart from the first elongated member, a top connecting element extending between and fastened to the top portions of the first and second panel members and a bottom connecting element extending between and fastened to the bottom portions of the first and second panel members.

2. The invention set forth in claim 1, wherein the elongated members have a plurality of slots therein along the lengths thereof, the slots being adapted to receive portions of brackets therein.

3. The invention set forth in claim 1, wherein the top and bottom portions of the first and second panel members each have a pair of slots therein, the top connecting element having a pair of opposite edges along the length thereof disposed within the pair of slots in the top portions of the first and second panel members and the bottom connecting element having a pair of opposite edges along the length thereof disposed within the pair of slots in the bottom portions of the first and second panel members.

4. The invention set forth in claim 1, wherein the facing portions of the first and second panel members each have a pair of slots therein along the lengths thereof for receiving the first and second elongated members therein.

5. An arrangement for joining first and second panels, eadh of the first and second panels having a top edge, a bottom edge, a side edge extending between the top and bottom edges, a pair of generally parallel, spaced-apart slots extending along the length of the side edge and along adjacent portions of the topand bottom edges, a pair of elongated standards extending between the side edges of the first and second panels along substantially the entire length of the side edges, the pair of elongated standards being disposed within different ones of the pair of slots in the side edges of the first and second panels, an elongated top connector extending between the first and second panels and having a central portion thereof and a pair of opposite, spaced-apart, generally parallel edges extending outwardly from the central portion and into different ones of the pair of slots in the top edges of the first and second panels, means for securing the top connector to the top edges of the first and second panels, an elongated bottom connector extending between the first and second panels and having a central portion thereof and a pair of opposite, spaced-apart, generally parallel edges extending outwardly from the central portion and into different ones of the pair of slots in the bottom edges of the first and second panels, and means for securing the bottom connector to the bottom edges of the first and second panels.

6. The invention set forth in claim 5, wherein each of the top and bottom connectors comprises an elongated piece of metal having having a uniform, generally U-shaped cross-section.

7. The invention set forth in claim 5, wherein the means for securing the top connector comprises screws extending through apertures in the top connector and into the top edges of the first and second panels and the means for securing the bottom connector comprises screws extending through apertures in the bottom connector and into the bottom edges of the first and second panels.

8. The invention set forth in claim 5, wherein the side edges of the first and second panels have a space therebetween and each of the standards has a plurality of slots therein along the length thereof and within said space.

9. The invention set forth in claim 8, further including at least one bracket having a main portion disposed outside of the space between the first and second panels and a finger portion extending into the space between the first and second panels and through a slot in one of the standards.

10. The invention set forth in claim 5, further including a top cap mounted on the top edge of the first panel, the top cap being generally coextensive with the top edge and having at least one mounting member mounted on the underside thereof, the mounting member having a pair of generally parallel edges residing in spaced-apart relation under tension within the pair of slots in the top edge of the first panel.

11. The invention set forth in claim 5, further including a plurality of support brackets mounted on the bottom edge of the first panel, each of the support brackets having a central portion thereof extending downwardly from the bottom edge, an upper arm extending transversely relative to and mounted on the central portion adjacent the bottom edge, a lower arm extending transversely relative to and mounted on the central portion on the opoposite side of the upper arm from the bottom edge, and a plurality of resilient elements mounted on the opposite ends of the upper and lower arms, and a pair of elongated base members disposed on opposite sides of the support brackets and secured to the opposite ends of the upper and lower arms by the resilient elements.

12. A panel arrangement comprising a relatively thin, generally planar panel having a top edge, a bottom edge, an opposite pair of side edges extending between the top and bottom edges and a pair of generally parallel, spaced-apart slots formed in and extending along the lengths of the top, bottom and side edges, a member having a side edge disposed adjacent and spaced-apart from one of the opposite pair of side edges of the panel and a pair of generally parallel, spaced-apart slots formed in and extending along the length of the side edge of the member, a pair of elongated standards disposed between and extending into different ones of the pair of slots in said one of the opposite pair of side edges of the panel and the side edge of the member, a top connector extending from an upper portion of the member and coupled to the top edge of the panel and having a pair of opposite, downwardly extending edges disposed within the pair of slots in the top edge of the panel, and bottom connector extending from a lower portion of the member and coupled to the bottom edge of the panel and having a pair of opposite, upwardly extending edges disposed within the pair of slots in the bottom edge of the panel.

13. The invention set forth in claim 12, wherein the member comprises an end post.

14. The invention set forth in claim 12, wherein the member comprises a corner post having a second side edge disposed adjacent and at a generally right angle relative to the first-mentioned side edge of the member and having a pair of generally parallel, spaced-apart slots therein, a second top connector extending from the upper portion of the member at a right angle relative to the first-mentioned top connector and a second bottom connector extending from the lower porton of the member at a right angle relative to the first-mentioned bottom connector.

15. A support bracket for mounting a panel and an opposite pair of panel bases comprising the combination of a central shaft portion having a mounting plate attached to a first end thereof and adapted to be coupled to a panel and a support foot attached to an opposite second end thereof, a first arm mounted on the central shaft adjacent the mounting plate and extending generally at a right angle relative to the central shaft, a second arm mounted on the central shaft on the opposite side of the first arm from the mounting plate and adjacent the support foot, and a plurality of resilient elements mounted on opposite ends of the first and second arms and adpated to resiliently receive an opposite pair of panel bases.

16. The invention set forth in claim 12, wherein the mounting plate includes an opposite pair of tabs extending outwardly in a direction opposite the support foot and the resilient element comprises a separate spring-loaded plunger mounted at each of the opposite ends of the first and second arms.

17. The invention set forth in claim 12, wherein the central shaft includes means for moving the support foot along the length of the central shaft to adjust the distance of the support foot from the mounting plate.

* * * * *

UNITED STATES PATENT AND TRADEMARK OFFICE

CERTIFICATE OF CORRECTION

PATENT NO. : 4,269,005

DATED : May 26, 1981

INVENTOR(S) : Jay Timmons

It is certified that error appears in the above-identified patent and that said Letters Patent are hereby corrected as shown below:

Column 1, line 38, after "3,713,257 of", strike the hyphen ("-"); line 39, before ", 3,694,975", "Beavres" should read --Beavers--; line 45, after "and" and before "for", "applicatons" should read --applications--; line 51, after "panel" and before "in" (second occurrence), "arrangment" should read --arrangement--. Column 2, line 40, after "gated" and before "standards", "striped-like" should read --strip-like--. Column 3, line 12, after "panels," and before "posts", "cente" should read --center--. Column 6, line 5, after "cap" and before "is", "38" should read --28--; line 30, after "wood" and before "such", "frane" should read --frame--. Column 8, line 26, after "relatively", "smally" should read --small--. Column 9, line 9, before "of", "lets" should read --legs--; line 24, after "and", "the" (third occurrence) should read --then--; line 26, after "14", strike "and 16". Column 11,

UNITED STATES PATENT AND TRADEMARK OFFICE

CERTIFICATE OF CORRECTION

PATENT NO. : 4,269,005

DATED : May 26, 1981

INVENTOR(S) : Jay Timmons

It is certified that error appears in the above-identified patent and that said Letters Patent are hereby corrected as shown below:

line 56, before "of", "eadh" should read --each--. Column 14, line 15, after "and" and before "to", "adpated" should read --adapted--.

Signed and Sealed this

*Fifteenth* Day of *September 1981*

[SEAL]

*Attest:*

GERALD J. MOSSINGHOFF

*Attesting Officer*

*Commissioner of Patents and Trademarks*